US005884837A

United States Patent [19]

Jacobsson et al.

[11] Patent Number: 5,884,837

[45] Date of Patent: Mar. 23, 1999

[54] OPENING ARRANGEMENT

[75] Inventors: Kenth Jacobsson, Södra Sandby; Christer Andersson, Lund; Hans Hesselroth, Malmö, all of Sweden

[73] Assignee: Tetra Laval Holdings & Finance S.A., Pully, Switzerland

[21] Appl. No.: 939,163

[22] Filed: Sep. 29, 1997

Related U.S. Application Data

[63] Continuation of Ser. No. 791,562, Jan. 31, 1997, abandoned.

[30] Foreign Application Priority Data

Feb. 2, 1996 [SE] Sweden ..... 9600381

[51] Int. Cl.[6] ..... B65D 5/54

[52] U.S. Cl. ..... 229/204; 30/2; 30/324

[58] Field of Search ..... 229/204, 401; 30/2, 324; 206/216, 542

[56] References Cited

U.S. PATENT DOCUMENTS

| | | | |
|---|---|---|---|
| 350,499 | 10/1886 | Noe | 229/401 |
| 893,043 | 7/1908 | Westerberg | 229/204 |
| 1,707,946 | 4/1929 | Roth | 229/204 |
| 2,070,034 | 2/1937 | Warren | 30/324 |
| 2,119,793 | 6/1938 | Plageman | 229/204 |
| 2,152,400 | 3/1939 | Rold | 229/204 |
| 2,609,715 | 9/1952 | Eades | 30/2 |
| 3,224,093 | 12/1965 | Huck | 30/324 |
| 4,858,766 | 8/1989 | Tsai | 229/242 |
| 5,080,263 | 1/1992 | Johnson | 220/277 |
| 5,395,298 | 3/1995 | Moesmann | 383/202 |
| 5,539,983 | 7/1996 | Reyburn et al. | 30/2 |

FOREIGN PATENT DOCUMENTS

| | | | |
|---|---|---|---|
| 950447 | 10/1956 | Germany | 229/204 |
| 406898 B | 3/1979 | Sweden . | |
| 4690 | 2/1910 | United Kingdom | 229/204 |

*Primary Examiner*—Gary E. Elkins
*Attorney, Agent, or Firm*—Burns, Doane, Swecker & Mathis, L.L.P.

[57] ABSTRACT

The invention relates to an opening arrangement for single-use disposable packages (1) of the type which are manufactured from a continuous material web or a material sheet. The packaging material consists of a core of paper or paperboard to which are laminated different layers of thermoplastics and possibly a barrier layer, normally consisting of aluminium foil.

The opening arrangement includes a hole (2) made in the packaging material and at least covered by the inside layer or layers of the packaging material, a perforation line (3) which extends at least from one side of the hole (2), and an outer penetration device (4) applied on the outside of the packaging container (1). One end of the penetration device (4) is designed as a hook (11).

The penetration device (4) is intended to be broken free from the packaging container (1) and, with the tip (20) of the hook-shaped portion (12), the layers covering the hole (2) are penetrated. The penetration device (4) is thereafter pulled along the perforation line (3) thereby opening a large part of the packaging container side (5, 8 or 10).

8 Claims, 2 Drawing Sheets

OPENING ARRANGEMENT

This application is a continuation, of application Ser. No. 08/791,562, filed Jan. 31, 1997, now abandoned.

TECHNICAL FIELD

The present invention relates to an opening arrangement for a packaging container of the type which is manufactured from a material web or from a material sheet, the arrangement comprising a hole punched in the packaging material and covered at least by the inside layer or layers of the packaging material, a perforation line and an outer penetration device.

BACKGROUND ART

Single-use disposable packages may be manufactured from a continuous material web or from a material sheet, the packaging material consisting of a laminate with a core of paper or paperboard to which are laminated different layers of thermoplastic and possibly also aluminium foil (Alifoil). These packages are common for liquid foods such as milk and fruit juices, but in recent times considerable interest has been focused on being able to pack foods of a higher viscosity such as, for example, puddings, creams and the like in packages of this type.

The packaging containers are formed and filled direct in a filling machine, in that the packaging material web is formed into a tube which is longitudinally joint sealed. The tube is filled with the contemplated contents and is then transversely sealed across the filled tube to form individual packaging container blanks. The blanks are separated from the tube and finally formed into finished, parallelepipedic packaging containers. The finished packaging container is often provided with some form of opening arrangement for affording convenient access to its contents.

Foods with a relatively solid consistency naturally require completely different opening arrangements than liquid foods which are intended to be poured from the package. For highly viscous products, the need is often to be able to open a larger part of the package in order by such means to get at the contents of the package more easily

OBJECT OF THE INVENTION

One object of the present invention is to realise an opening arrangement which is particularly adapted for products of high viscosity, allowing the consumer directly and conveniently to gain access to the contents of the packaging container, without the need for external aids such as scissors.

SOLUTION

This and other objects have been attained according to the present invention in that the opening arrangement of the type disclosed by way of introduction has been given the characterizing features that the one end of the outer penetration device is designed as a hook, and that the perforation line extends at least from one side of the punched hole.

Preferred embodiments of the present invention have further been given the characterizing features as set forth in the appended subclaims.

BRIEF DESCRIPTION OF THE ACCOMPANYING DRAWINGS

One preferred embodiment of the present invention will now be described in greater detail hereinbelow, with particular reference to the accompanying Drawings, in which.

DESCRIPTION OF PREFERRED EMBODIMENTS

Figure 1:
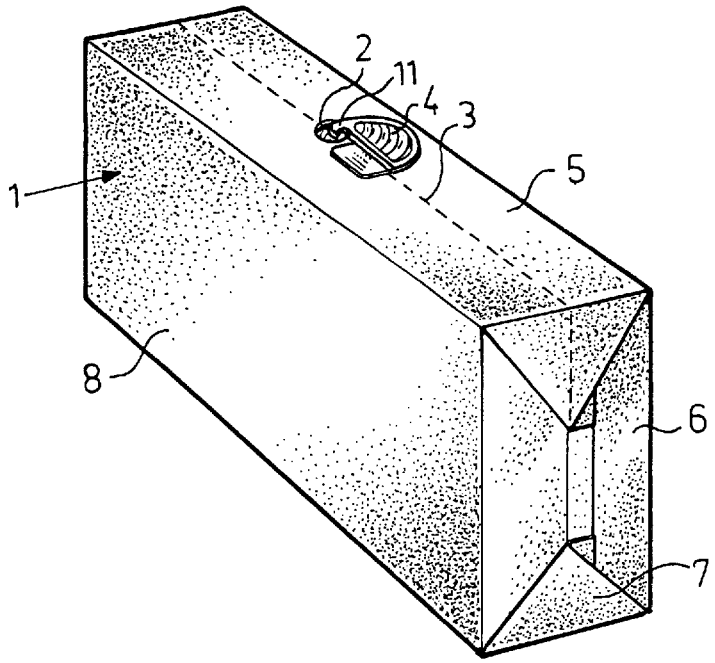
FIG. 1 shows a first preferred embodiment of the present invention.
Figure 2:
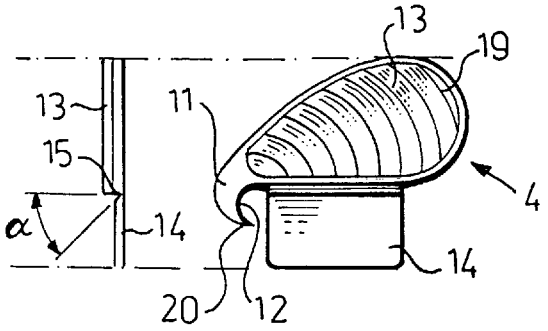
FIG. 2 shows the penetration device in the first preferred embodiment.

The opening arrangement according to the invention is intended for packaging containers 1 of the single-use disposable type which are manufactured from a continuous web of packaging material, or alternatively from a material sheet. The packaging material consists of a laminate with a core of paper or paperboard. To this core, various layers of thermoplastics are laminated, and cover the paper core on both sides. Packaging containers 1 which are intended for aseptic products moreover include a barrier layer of, for example, aluminium foil.

In a filling machine, the continuous packaging material web is formed into a tube which is longitudinally joint sealed, and the tube is filled with the intended contents. Transverse seals are then made through the filled tube, so that packaging container blanks are obtained, and the packaging container blanks are separated from the tube in the transverse seals. The individual packaging container blanks are finally formed into finished, parallelepipedic packaging containers 1.

The opening arrangement according to the present invention comprises a hole 2 made in the packaging material, a perforation line 3 which extends at least from one side of the thus provided hole 2, and an outer penetration device 4, this having been applied on the outer side of the packaging container 1.

The hole 2 is preferably round or has rounded edges. The round hole 2 has a diameter of approximately 3–7 mm. Suitably, the hole 2 is punched out already on manufacture of the packaging material, so that the hole 2 is provided in the inner core layer of paper. Hereby, the hole 2 will thus, in the continued manufacturing of the packaging material, be covered by at least the inside layer or layers of the packaging material which also includes the barrier layer of, for example, aluminium foil. The hole 2 is punched in the packaging material web in register so that the hole 2 always has the same, desired placing on the finished packaging container 1. Alternatively, the hole 2 may be of different design so that it is shaped with a tip which merges in the perforation line 3. Depending upon whether the perforation line 3 departs from one or two opposing sides of the hole 2, the hole 2 correspondingly has one or two tips which constitute the beginning of the perforation line 3.

FIG. 1 shows a first embodiment of the present invention, with a placing of the hole 2 in the one side wall 5 of the packaging container 1. In this Figure, the packaging container 1 is shown from its bottom wall 6, with the two inwardly folded bottom flaps 7. The hole 2 in this embodiment may technically be placed anywhere whatever on this side wall 5, but the perforation line 3 must, however, coincide with at least one side of the hole 2. Alternatively, the hole 2 could be placed on the front wall 8 of the packaging container 1, with corresponding placing of the perforation line 3. However, it is less suitable to place the hole 2 and perforation line 3 of the opening arrangement on the rear wall of the packaging container 1, since this wall also carries the longitudinal joint seam of the packaging container 1.

Figure 4:
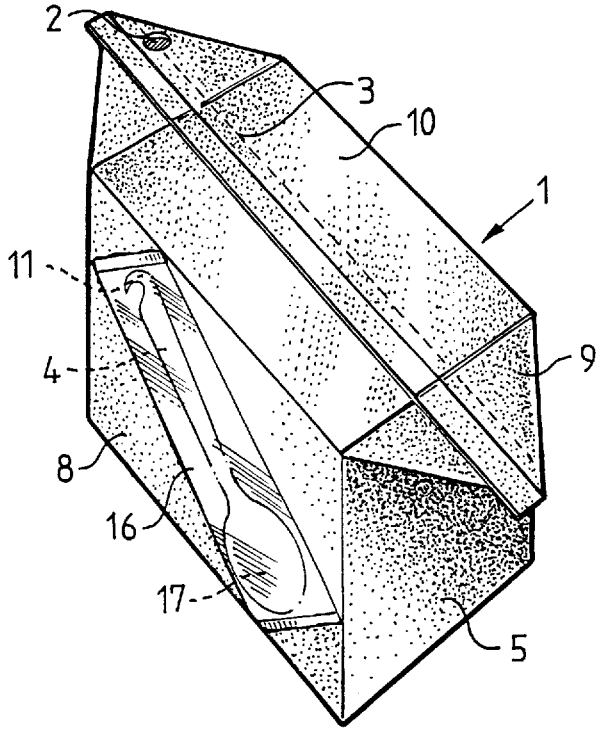
FIG. 4 shows a second preferred embodiment of the present invention.

FIG. 4 shows a second embodiment of the present invention with an alternative placing of the hole 2 in the one top flap 9 of the packaging container 1, this top flap in principle forming an extension of the top wall 10 of the packaging container, where the perforation line 3 is also placed. FIG. 4 shows the two top flaps 9 raised from their sealing to the side walls 5.

The perforation line 3 is also suitably made at the same stage of the manufacturing process of the packaging material as the hole 2, i.e. on the inner core layer of paper. The perforation line 3 will thus, like the hole 2, be covered by the various thermoplastic layers and the barrier layer of the packaging container 1.

In FIG. 1, the perforation line 3 extends parallel with the longitudinal direction of the packaging material web, which, in this embodiment, will coincide with one of the side walls 5 of the packaging container 1. The hole 2 is here placed approximately midway on the side wall 5, with the result that the perforation line 3 will extend from two opposing sides of the hole 2.

In FIG. 4, the perforation line is transversely placed, i.e. at 90° in relation to the longitudinal direction of the packaging material web, and it coincides in this embodiment with the top wall 10 and top flaps 9 of the packaging container 1. Here, the hole 2 is placed so that the perforation line 3 only extends from one side of the hole 2. Alternatively, the hole 2 could be more centrally placed on the top wall 10, coinciding with the perforation line 3.

The finished individual packaging containers 1 thus provided with a hole 2 and a perforation line 3 extending from the hole 2 have an outer penetration device 4 applied on their outside. The penetration device 4, which may be manufactured from a heat-sealable plastic, may have different outer configurations. What is common to the different embodiments of the penetration device 4 is, however, that in its one end the penetration device 4 is provided with a barb or hook 11 with a tip 20 and a bevelled inner edge 12.

In the first embodiment which is illustrated in FIG. 1, the penetration device 4 is in the form of a gripping tab 13 with the hook 11 in its one end and an application tab 14 connected to the gripping tab 13. The penetration device 4 is here applied on the outside of the packaging container 1 so that the hook 11 will partly cover the hole 2 and with the tip 20 of the hook approximately in register with the hole 2.

The penetration device 4 according to this embodiment is fixed in place in that the application tab 14 is secured to the outer thermoplastic layer of the packaging container 1 by a hot melt operation. This takes place normally in a special applicator machine placed after the filling machine which produces the packaging containers 1. While the application tab 14 is connected to the packaging container 1, the gripping tab 13 is free. A bevel 15 is provided between the gripping tab 13 and the application tab 14.

Figure 5:
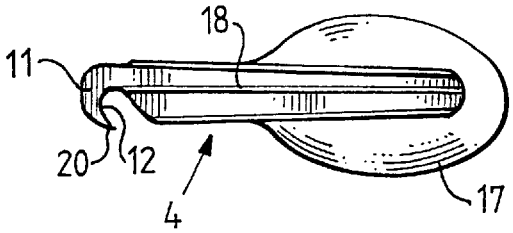
FIGS. 5–6 show the penetration device in the second preferred embodiment.
Figure 6:
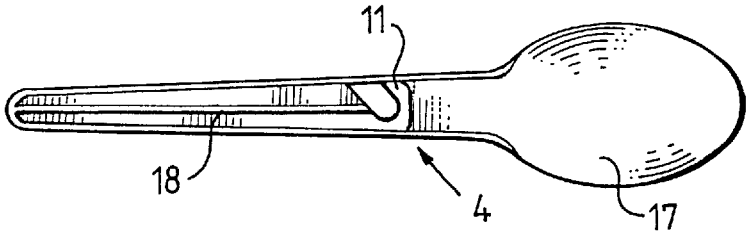

The penetration device 4 in the second embodiment, as shown in FIGS. 5 and 6, has the outer form of a spoon. The spoon-shaped penetration device 4 may be secured to the packaging container wall as shown in FIG. 4, where each penetration device 4 is enclosed in a plastic envelope 16, the plastic envelope 16 being applied by a hot melt operation to the outer thermoplastic layer of the packaging container wall. The plastic envelope 16 is formed in that a large number of spoon-shaped penetration devices 4 are oriented and enclosed between two plastic strips which are sealed to one another in their outer edges and between each individual penetration device 4. The continuous strips with enclosed penetration device are severed from the strip to form individual plastic envelopes 16 which are placed separately on a packaging container 1 in a special machine intended for this purpose.

FIG. 4 shows a spoon-shaped penetration device 4 with a fixed hook 11 at that end of the spoon which is turned to face away from the blade 17 of the spoon. FIGS. 5 and 6 show a spoon-shaped penetration device 4 in which, as shown in FIG. 5, the shaft 18 of the spoon is folded in towards the blade 17 of the spoon and where a hook 11 in this position is exposed in the end of the spoon. By opening out the shaft 18 of the spoon, the hook 11 will be utilized for locking the spoon shaft 18 in this position and the penetration device 4 changes into a spoon.

Figure 3:
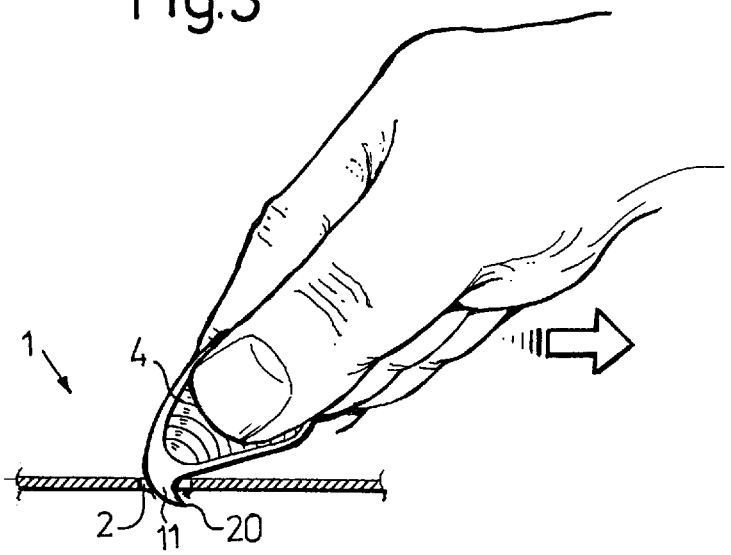
FIG. 3 shows how the first preferred embodiment is handled when opening.

When the consumer wishes to open a packaging container 1 with an opening arrangement according to the first embodiment of the present invention, the packaging container 1 has the appearance as shown in FIG. 1. In such instance, the consumer is to grasp the free gripping tab 13 which may be designed with creases or grooves 19 in the plastic in order to facilitate gripping. Thereafter, the consumer folds up the gripping tab 13, which is made possible as a result of the bevel 15 between the gripping tab 13 and the application tab 14. The gripping tab 13 may be angled at an angle $\alpha$, which is approximately 45°. When this angle movement continues, the gripping tab 13 of the penetration device 4 will be broken free from the application tab 14, at the same time as the tip 20 on the penetration device 4 will penetrate the covering layer or layers of the hole 2. The penetration device 4 is now in a position to be pulled from the hole 2 along the perforation line 3 as shown in FIG. 3, where the penetration device 4 is pulled in the direction of the arrow, so that the bevelled edge 12 of the hook 11 cuts open the packaging container 1 along the perforation line 3. When the packaging container 1 in FIG. 1—the first embodiment—is opened, the top and bottom flaps 9 and 6, respectively, may be lifted up whereby a large opening is obtained which facilitates access to the contents of the packaging container, given that an opening arrangement according to the present invention is principally intended for highly viscous products such as puddings, creams and the like.

In a similar manner, the packaging container in FIG. 4 is opened in that the consumer releases the penetration device 4 from the outside of the packaging container 1 and removes the surrounding plastic envelope 16. By using the hook-shaped end of the spoon-like penetration device 4, the packaging container 1 is opened in a corresponding manner in that the tip 20 of the hook 11 penetrates the packaging container 1 in the hole 2 and the hook 11 is thereafter pulled along the perforation line 3. The spoon-like penetration device 4 may then be employed as a spoon for accessing the contents of the packaging container 1 in a convenient and aesthetically satisfactory manner.

As will have been apparent from the foregoing description, the present invention realises an opening arrangement for single-use disposable packages with contents of a high viscosity and in which it is necessary to create a large opening in the package.

Furthermore, the different embodiments have been adapted so that the filled product, for example without external utensils, may be consumed using the appended spoon.

The present invention should not be considered as restricted to that described above and shown on the Drawings, many modifications being conceivable without departing from the spirit and scope of the appended Claims.

What is claimed is:

1. An opening arrangement for a packaging container of the type which is manufactured from a material web or from a material sheet, the arrangement comprising a hole punched in the packaging material and covered at least by the inside layer or layers of the packaging material, a perforation line and an outer penetration device, wherein one end of the outer penetration device is designed as a hook, and the perforation line extends at least from one side of the punched hole.

2. The opening arrangement as claimed in claim 1, wherein the penetration device is applied on the outside of the packaging container.

3. The opening arrangement as claimed in claim 1, wherein the hook of the penetration device is disposed to penetrate the layer or layers covering the hole and thereafter to be pulled along the perforation line.

4. The opening arrangement as claimed in claim 2, wherein the penetration device is applied on the packaging container so that the tip of its hook is placed in register with the punched hole.

5. The opening arrangement as claimed in claim 4, wherein the penetration device consists of a gripping tab which in its one end displays said hook and which, by means of a bevel, is connected to an application tab.

6. The opening arrangement as claimed in claim 2, wherein the penetration device constitutes the one end of a spoon.

7. The opening arrangement as claimed in claim 6, wherein the shaft of the spoon is folded in towards the blade of the spoon, exposing the hook.

8. The opening arrangement as claimed in claim 6, wherein the hook constitutes a fixed continuation of the shaft of the spoon.

* * * * *